US008708098B2

(12) United States Patent
Roy

(10) Patent No.: US 8,708,098 B2
(45) Date of Patent: Apr. 29, 2014

(54) SUPPORT MEMBRANE FOR FLOORS, CEILINGS OR RESIDENTIAL WALLS

(76) Inventor: Sylvain Roy, Rosemere (CA)

( * ) Notice: Subject to any disclaimer, the term of this patent is extended or adjusted under 35 U.S.C. 154(b) by 131 days.

(21) Appl. No.: 13/126,818

(22) PCT Filed: Dec. 9, 2009

(86) PCT No.: PCT/CA2009/001810

§ 371 (c)(1),
(2), (4) Date: Nov. 9, 2011

(87) PCT Pub. No.: WO2010/088753

PCT Pub. Date: Aug. 12, 2010

(65) Prior Publication Data

US 2012/0125712 A1 May 24, 2012

(30) Foreign Application Priority Data

Feb. 9, 2009 (CA) ..... 2652693

(51) Int. Cl.

| | |
|---|---|
| ***E04B 1/84*** | (2006.01) |
| ***E04B 1/82*** | (2006.01) |
| ***E04B 2/02*** | (2006.01) |
| ***E04F 15/20*** | (2006.01) |
| *E04B 1/74* | (2006.01) |
| *E04B 2/00* | (2006.01) |
| *E04F 15/00* | (2006.01) |

(52) U.S. Cl.
USPC ..... 181/294; 181/290; 52/403.1; 52/145

(58) Field of Classification Search
USPC ..... 181/294, 290; 52/403.1, 144, 145
See application file for complete search history.

(56) References Cited

U.S. PATENT DOCUMENTS 4,927,705 A * 5/1990 Syme et al. ..... 428/192

(Continued)

FOREIGN PATENT DOCUMENTS

| | | |
|---|---|---|
| CA | 2 190 024 A1 | 5/1998 |
| CA | 2 313 921 A1 | 12/2001 |

(Continued)

*Primary Examiner* — Edgardo San Martin
(74) *Attorney, Agent, or Firm* — Equinox IP; Franz Bonsang

(57) ABSTRACT

A support membrane designed to be arranged with a covering that can be applied to bearing areas such as floors or even under and on concrete screeds for a floor is provided. Said membrane can also be used in the composition of ceilings and in the composition of residential walls. The membrane includes a base layer made of fibers and designed to be arranged directly on the bearing area so as to absorb sound waves and to level the irregularities of the bearing area, a vapor barrier-anchoring membrane, and optionally an underlay designed to receive the covering and provide an anchor for the finishing products. Said support membrane is characterized in that the vapor barrier-anchoring membrane thereof is applied in liquid form by hot-melting directly on the base layer and on the underlay whenever the latter is used. Said support membrane improves heat transmission by reflectivity in the room in which the wall, floor or ceiling is located, as well as guaranteeing much more efficient predefined laying of the floor thanks to the anchoring membrane contained by the former, which reduces the tension effect the floor finish can cause.

18 Claims, 4 Drawing Sheets

(56) References Cited

U.S. PATENT DOCUMENTS

| | | | | |
|---|---|---|---|---|
| 6,077,613 | A * | 6/2000 | Gaffigan | 428/442 |
| 7,047,705 | B2 * | 5/2006 | Foster | 52/747.1 |
| 7,096,631 | B1 * | 8/2006 | Counihan | 52/403.1 |
| 7,651,757 | B2 * | 1/2010 | Jones et al. | 428/172 |
| 7,837,009 | B2 * | 11/2010 | Gross et al. | 181/290 |
| 8,171,687 | B2 * | 5/2012 | Dellinger et al. | 52/408 |
| 2003/0102184 | A1 * | 6/2003 | Brisson et al. | 181/290 |
| 2003/0154676 | A1 * | 8/2003 | Schwartz | 52/391 |
| 2005/0279574 | A1 * | 12/2005 | Halterbeck et al. | 181/293 |
| 2007/0039268 | A1 * | 2/2007 | Ambrose et al. | 52/403.1 |
| 2009/0151285 | A1 * | 6/2009 | Tunte et al. | 52/403.1 |
| 2010/0077684 | A1 * | 4/2010 | Socha | 52/403.1 |

FOREIGN PATENT DOCUMENTS

| | | | |
|---|---|---|---|
| CA | 2135236 | C | 3/2004 |
| CA | 2 421 458 | A1 | 4/2004 |
| CA | 2 514 954 | A1 | 8/2004 |
| CA | 2 586 524 | A1 | 5/2006 |
| CA | 2603421 | A1 | 10/2006 |
| CA | 2738460 | A1 | 4/2010 |
| CH | 692 510 | A5 | 7/2002 |
| EP | 0 736 646 | A1 | 10/1996 |
| EP | 1 365 086 | A2 | 11/2003 |
| GB | 2 349 356 | A | 11/2000 |
| JP | 7189357 | A | 7/1995 |
| WO | 2005/097873 | A2 | 10/2005 |

* cited by examiner

SUPPORT MEMBRANE FOR FLOORS, CEILINGS OR RESIDENTIAL WALLS

CROSS-REFERENCE TO RELATED APPLICATIONS

This application is a National Stage of International Patent Application No. PCT/CA2009/001810, filed on Dec. 9, 2009, which claims priority to foreign Patent Application No. CA 2,652,693, filed on Feb. 9, 2009, the contents of which are incorporated herein by reference in their entireties.

FIELD OF THE INVENTION

The present invention relates to a support membrane devised to be used with a covering installable onto a carrying surface.

More specifically, the present invention relates to a support membrane that can be positioned under any kind of floor, such as wooden floors, suspended floors, engineering floors or ceramic floors, or under or above a concrete screed floor, without risk of damaging the finish of said floor. The same membrane can also be used for the construction of ceilings or residential walls. It can also be integrated to any kind of pre-fabricated materials, such as for example, plywood, gypsum, rubber panels, concrete panels, or pre-glued membranes, in order to obtain acoustic and thermal requirements.

BACKGROUND OF THE INVENTION

There are already numerous support membranes intended to be used for the construction of floors and ceilings, for the purpose of obtaining a thermal and/or acoustic insulation. However, none of them so far provide all of these features. As non limitative examples of such membranes, reference can be made to those described in the following documents:

1. Canadian patent no. 2.190.024 to Royal Mat;
2. Canadian patent no. 2.313.921 to Soleno Textiles;
3. Canadian patent no. 2.421.458 to Soleno Textiles;
4. Canadian laid-open application no. 2.514.954 to Royal Mat; and
5. Canadian laid-open application no. 2.586.524 to Soprema.

SUMMARY OF THE INVENTION

The object of the present invention is a new kind of support membrane which, thanks to its structure and process of manufacture, permits, on the one hand, to improve transmission of heat by reflectivity in the room where the wall, ceiling or floor is located, and, on the other hand, to make sure that the installation of the floor be much more efficient, thanks to an anchoring membrane which is incorporated therein and permits to reduce the tension effect that may be caused by the covering of the floor, such as a glued floor, ceramics, natural stones or placoplaster sheets.

More precisely, the object of the present invention as claimed is a support membrane devised to be used with a covering installed onto a carrying surface, said support membrane comprising:

a base layer made of fibers and devised to be positioned onto the carrying surface in order to absorb sound waves and to level irregularities of said carrying surface; and an anchoring membrane acting as a vapor barrier.

According to the invention, this support membrane is characterized in that the anchoring membrane acting as a vapor barrier, is applied in a liquid form by thermo-fusion onto the base layer.

The support membrane according to the invention may also comprise a positioning layer made of fibers and applied onto the anchoring membrane, while this anchoring membrane is still in a liquid form during its application by thermo-fusion. This positioning layer is devised to receive the covering and act as an anchor for the finishing products, in order to reduce the tension effect that may be caused by this covering when the same is made of wood, ceramic or placoplaster, whether it be vertical in the case of a wall, or horizontal in the case of a floor.

The presence of an anchoring membrane that acts as a vapor barrier and is applied by thermo-fusion, is a very important characteristic, inasmuch as it permits the installation of any kind of wood floor, which is essential in the floor market, whatever be the method of installation, that is, by floating installation, glued installation, or over glued. It is indeed not suggested nor even recommended in the industrial market, to install floor finishes made of wood, without a substantial risk of damaging the floor, where the carrying surface made of concrete, has a humidity rate higher than 4%. It is therefore compulsory to use a membrane acting as vapor barrier.

More specifically, the market requires that a standard identified as ASTM E 96, be satisfied. According to this standard, a rate equal to or lower than 3.3 gr. of water per square meter must be obtained for 24 hours.

With the present invention, it has been found that by using a thermo-fusion process for incorporating an anchoring membrane acting as a vapor barrier into a support membrane, one may obtain a rate of only 2.2 gr. of water per square meter, when tests were carried out with water vapor for 24 hours.

In accordance with a preferred embodiment of the invention, the base layer preferably has a thickness ranging from 1 to 8 mm, and the anchoring membrane acting as a vapor barrier, preferably has a thickness ranging from 1 to 6 mm. When use is made of a positioning layer, this positioning layer preferably has a thickness ranging from 1 to 6 mm.

According to another preferred embodiment of the invention, the base layer and the positioning layer are made of needled or weaved fibers, and each have a weight ranging from 35 to 3000 grams per square meter.

If desired, the base layer, the positioning layer or both of them, can also comprise an antimicrobial agent.

Similarly, the base member, the positioning layer, or both of them, can also comprise nanotechnological fibers covered with a layer of metal, in order to give them a reflective effect.

If desired, the support membrane according to the invention may be pre-glued in a monolayer or multilayer form, onto a panel made of plywood, gypsum, rubber, fibro concrete or bitumen.

BRIEF DESCRIPTION OF THE DRAWINGS

The invention, its structure and its various advantages, will be better understood upon reading the following non-restrictive description made with reference to the accompanying drawings, wherein.

DETAILED DESCRIPTION

Figure 1:
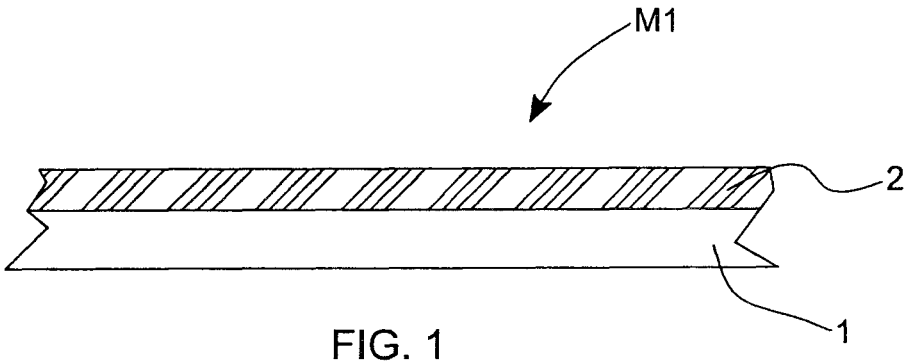
FIG. 1 is a schematic cross-sectional view of a support membrane according to a first preferred embodiment of the invention.
Figure 2:
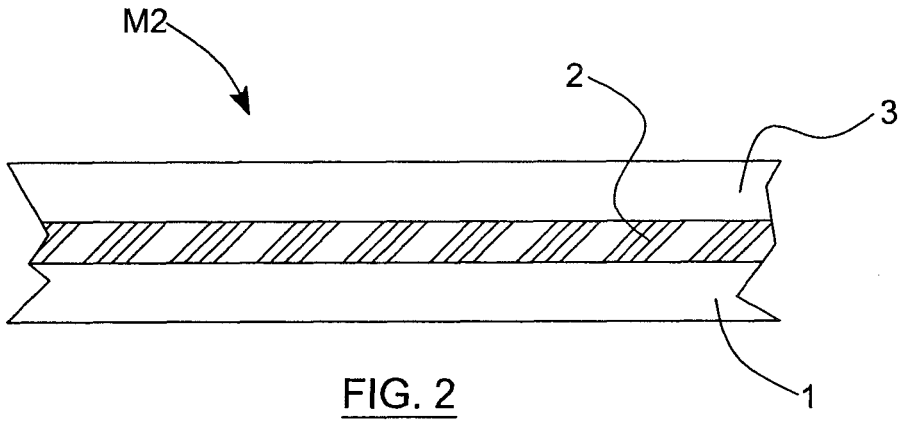
FIG. 2 is a schematic cross-sectional view of a support membrane according to a second preferred embodiment of the invention.

As aforesaid, FIGS. 1 and 2 illustrate two support membranes according to the invention, which are respectively identified as M1 and M2.

In these two illustrated embodiments, the support membrane comprises a base layer 1 which is devised to be positioned onto a carrying surface in order to absorb sound waves and to level irregularities that may be present on this carrying surface. This base layer 1 is preferably made of needled and/or weaved fibers, that are made of flexible materials consisting of synthetic short or long fibers made of polymers, such as polyester, polypropylene or polyethylene, and/or of short or long fibers that are natural or cellulosic such as fibers of cotton, jute, linen or hemp. The base layer 1 preferably has a thickness ranging from 1 to 8 mm and a weight that is ranging from 35 and 3000 grams per square meter.

In the preferred embodiment illustrated in FIG. 2, the support membrane according to the invention, also comprises a positioning layer 3 which is devised to receive any kind of wood or wall covering, and thus reduce the tension effect that may be caused by this covering.

This positioning layer 3 which is needled and/or weaved, can also be made of fibers of polyethylene, polypropylene, polyester or any other kind of natural or synthetic fibers in part or as a whole. Preferably, this positioning layer has a thickness ranging from 1 to 6 mm and a weight ranging from 35 to 3000 grams per square meter.

The support membrane according to the invention differs from the support membranes that are already known, in that it also comprises an anchoring membrane 2 acting as a vapor barrier, which is applied by thermo-fusion in a liquid form at a high temperature of 100 and 350 degrees, directly onto the base layer 1, or in between the base layer 1 and the positioning layer 3 when the latter is present, thereby making impossible a delamination of said base layer 1 and/or positioning layer 3, inasmuch as the anchoring membrane 2 is fixed by fusion in a perfect way.

The anchoring membrane 2 acting as a vapor barrier, preferably has a thickness ranging from 1 to 6 mm, and is advantageously made of polyester, polypropylene or polyethylene. So, for example, the anchoring membrane 2 acting as a vapor barrier, can be made of polyethylene of low, medium or high density, including a basic component consisting of 5 to 20% of polyester, but that does not exclude other chemical or non-chemical mixtures.

Figure 6:
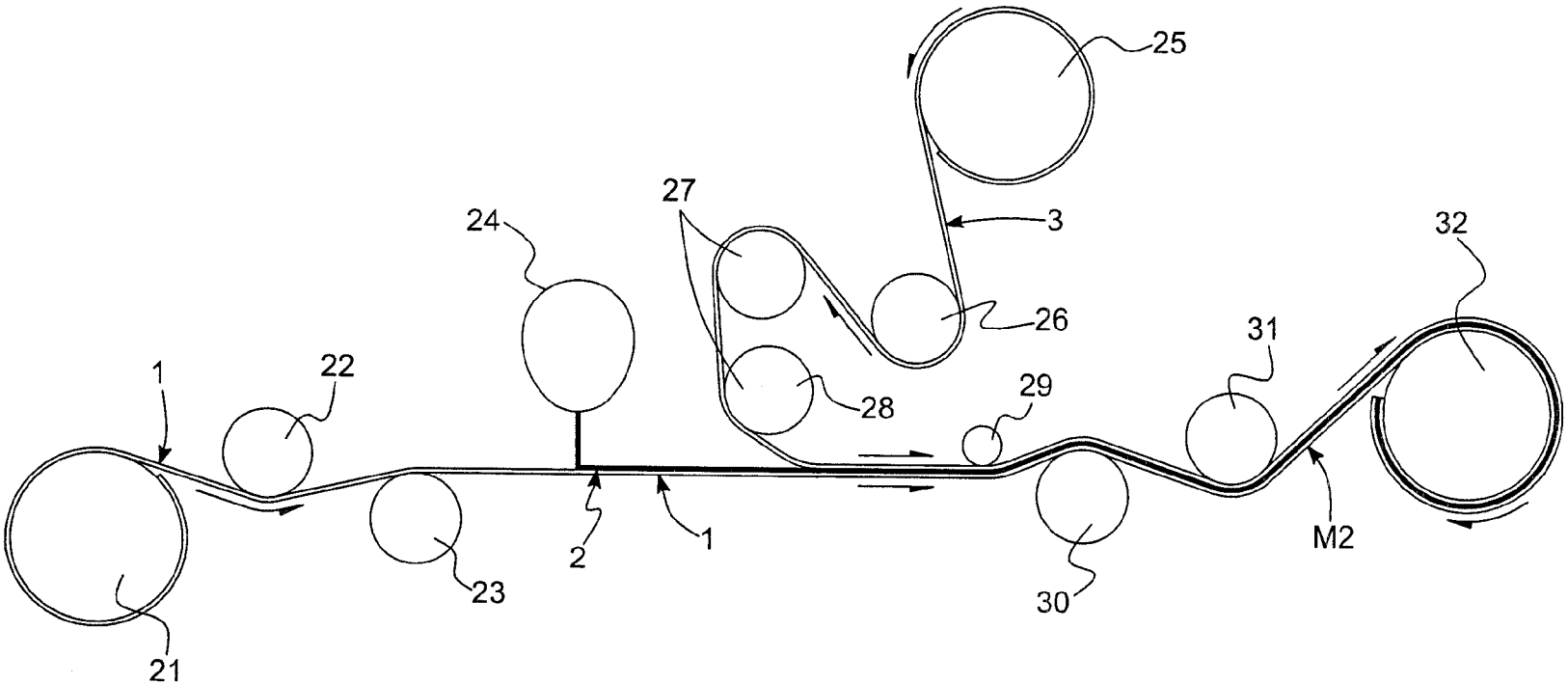
FIG. 6 is a schematic view of the kind of equipment that can be used, in order to manufacture the support membrane according to the invention.

FIG. 6 is a schematic view of the kind of equipment that may be used to apply by thermo-fusion the anchoring membrane acting as a vapor barrier to the base layer 1, and eventually the positioning layer 3, when this positioning layer is present.

As is illustrated in this schematic view, the base layer 1 comes from a roller 21 located at one end of the equipment. The base layer 1 is brought via tensing rollers 22 and 23 close to a thermal spreader 24 which projects the constitutional elements of the anchoring membrane 2 acting as a vapor barrier, in the form of a hot liquid that is applied directly onto the base layer 1 and is hardened and glued onto same.

When the support membrane according to the invention also comprises a positioning layer 3, this layer is brought from a roller 25 via one or several other tensing rollers 26, 27 and 28 so as to be applied to the layer of the anchoring membrane 2 that is still in a liquid form, before this anchoring membrane is completely hardened. The whole assembly thereafter passes between several tensing rollers 29, 30 and 31, in order to give the final form to the support membrane, which is then rolled up onto a roller 32 positioned at the other end of the equipment.

The basic concept of the present invention is thus to connect by thermo-fusion, two fibrous bodies, such a connection allowing the application of adhesives onto a positioning layer and a base layer commonly available on the market, and thus allowing the installation onto carrying surfaces made of bitumen or onto floor finishes made of wood, without risk of delamination of these floor finishes.

The purpose of the present invention is to provide an integral and perfect cohesion by thermo-fusion of the base layer and positioning layer even when the positioning layer is used for a long period of time, which is something that is not necessarily achieved with methods consisting of conventional lamination processes with conventional adhesives.

So, thanks to its structure, the support membrane according to the invention meets and satisfies each of the following standards:

ASTM E 96: (water vapor)

ASTM E-1007-04 and ASTM E-989-89 (99): (acoustic noise impact)

ASTM E-336-97 and ASTM E-413-04: (acoustic aerial noise)

Thanks to its structure, the support membrane according to the invention can, during the installation of a wood floor or ceramic floor, receive any kind of adhesive, even if such an adhesive contains water or polyurethane or such an adhesive contains a solvent, as is commonly used for the installation of such a finish, without risk of delamination of the membrane.

Advantageously, nanotechnological fibers covered with a layer of reflective metal can be incorporated into the base layer 1, in order to give to this base layer 1 a reflective effect. This is important inasmuch as, in order to obtain a reflective effect, there must be a space between the membrane and the surface of the finish. Of course, the same nanotechnological fibers covered with a layer of reflective metal can also be incorporated to the positioning layer 3 without necessarily being present in the base layer 1.

These nanotechnological fibers are preferably ultra fibers that are made of polymers or a natural source and are covered with a layer of nanotechnological metalized aluminum reflecting the energy by reflection. These fibers can be used in the base layer 1 and/or in the positioning layer 3 at a range that may vary from 1 to 100% depending on the kind of thermal performance that is being sought.

Advantageously also, metalized reflecting particles can also be incorporated, if desired, into the basic mixture used for manufacturing the anchoring membrane 2 acting as a vapor barrier 2 by thermo-fusion, while this membrane is applied onto the base layer and/or positioning layer 3.

If need be, an antimicrobial agent can also be incorporated into the base layer 1, in order to make it ecological. If desired, this antimicrobial agent can also be incorporated into the positioning layer 3. For this purpose, use can be made for example, of a silver salt at a concentration rate of 1 to 100%, which is known to liberate silver ions that penetrate the cellular parts of the microbes and destroy them. Any other treatment means acting in the same way could also be considered.

As can therefore be understood:

the base layer 1 is intended to be used to obtain an acoustic effect by absorbing the sound waves while leveling irregularities that may be present in the carrying surface, like the wall or floor on which it is positioned;

the reflective fibers that are inserted within the base layer 1 and/or the positioning layer 3, are intended to be used for transmitting heat by reflection into the place where the wall, ceiling or floor is located, and the membrane is installed;

the anchoring membrane 2 acting as a vapor barrier applied by thermo-fusion, is intended to be used for providing a protection against humidity, especially for an assembly, a floor or a wall, while simultaneously ensuring a mechanical support and a non-delamination of the base layer 1 and of the positioning layer 3, by fusioning them for a long term; and the positioning layer 3 is intended to be used for the positioning of a finish onto a glued floor, ceramic, natural stone or placoplaster sheet, or another finish. This positioning layer 3 actually has the function of reducing the tension effect that may be caused by the floor covering, which tension effect can sometimes be enormous. Such is actually achieved thanks to a perfect cohesion between the base layer 1 and the positioning layer 3.

The anchoring membrane 2 is of course used to connect the base layer 1 to the positioning layer 3 by lamination, when such a positioning layer 3 is used. Of course, when there is an incorporation of metallic particles into the anchoring membrane 2, this membrane also has a reflective effect.

Thanks to its structure, the anchoring membrane 2 which acts as a vapor barrier, and can also have a reflective effect, has the advantage of creating an air space, once a wood finish, ceramic, or any other kind of floor finish or other element has been applied to the floor, ceiling or wall of a building. By providing such an air space, the anchoring membrane 2 acting as a vapor barrier and incorporating reflective fibers, has the advantage of optimizing the reflection effect while still working as a vapor barrier.

Figure 5:
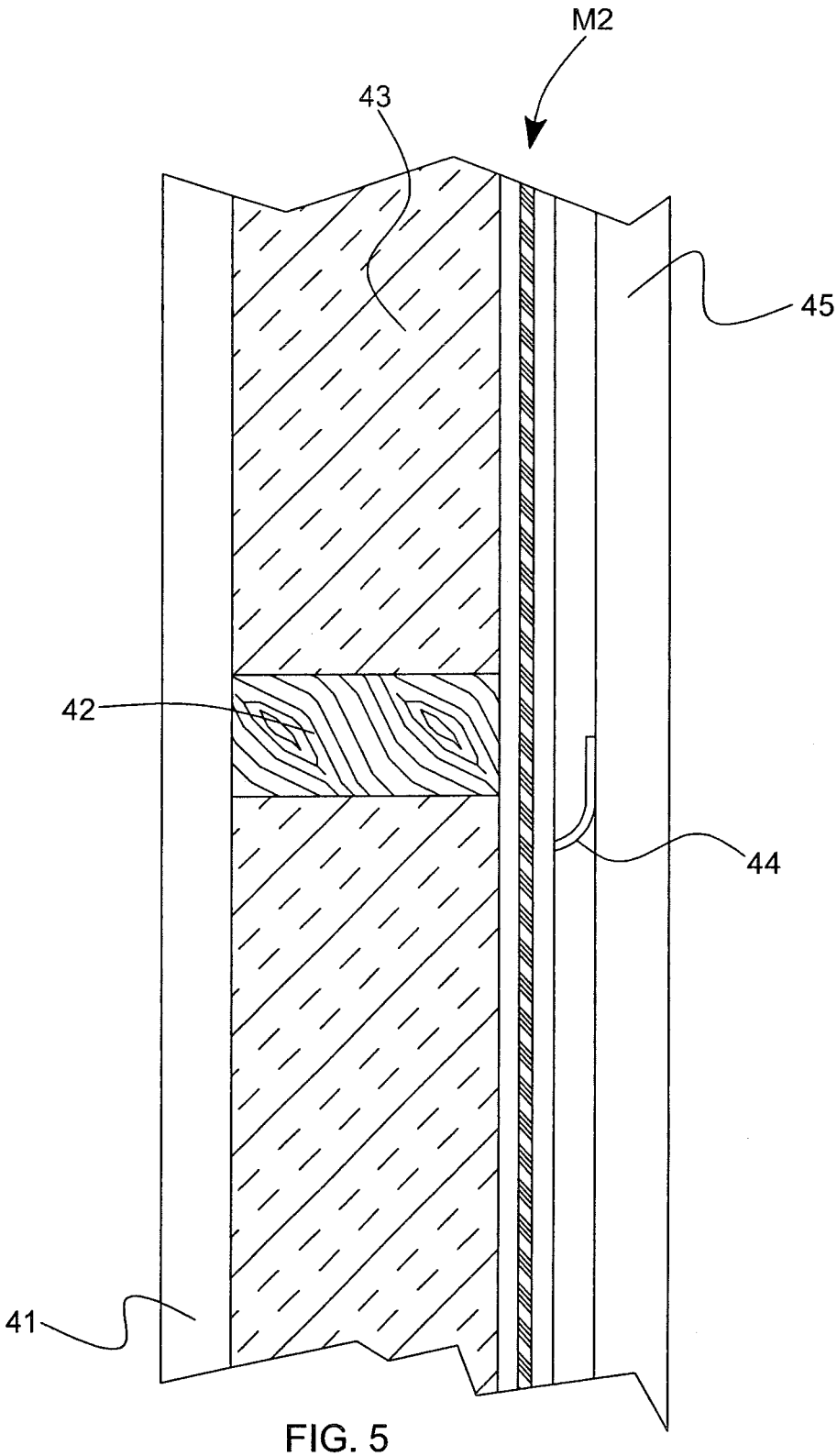
FIG. 5 is a sectional side view of the inside of a wall, within which a support membrane according to the invention is integrated.

The support membrane according to the invention as it has been described hereinabove, has the advantage of being universal. Indeed, it can be used for floors that are glued or are in a floating mode, as well as for the installation of ceramic tiles, natural stones or gypsum, while still providing its vapor barrier effect. It can also be used under concrete screed floors, or in the manufacture of ceilings or walls, as is illustrated in FIG. 5, which is a cross-sectional view of a part of a wall that structurally comprises when seen from left to right:

the external covering 41 of a building (or a placoplaster sheet in the case of an interior wall);

supporting pieces 42 made of wood;

a support membrane M2 according to the invention, fixed onto the supporting pieces 42 opposite to the external covering 41, the space in between being filled with wool 43 or any other analogous insulating material;

a coating 44 made of wood or metal; and placoplaster sheets or any other internal wall element 45.

Figure 3:
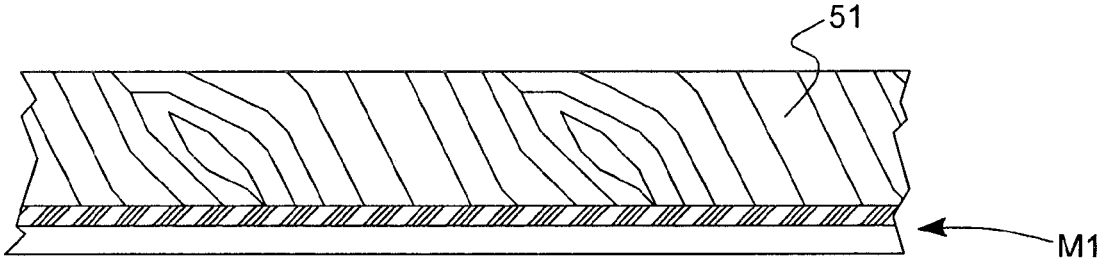
FIG. 3 is a schematic cross-sectional view showing the way a support membrane according to the invention can be applied onto a panel of plywood, gypsum, rubber, fibro concrete or bitumen.
Figure 4:
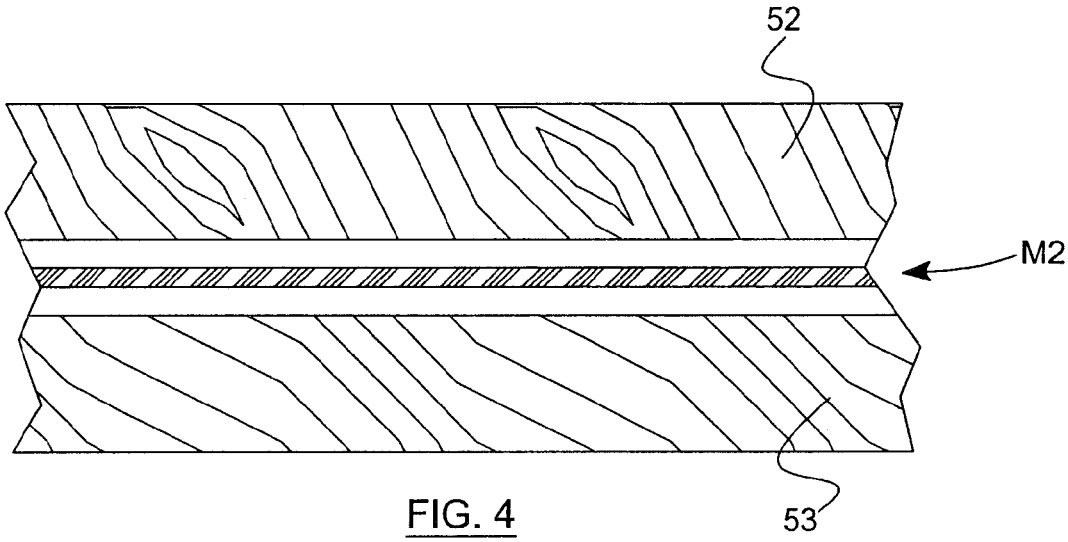
FIG. 4 is a view similar to FIG. 3, illustrating the same membrane applied between two panels of plywood, gypsum, rubber, fibro concrete or bitumen.

It will be understood that, in practice, in order to be easily installed, the support membrane according to the invention, can be pre-glued to a panel, as is illustrated in FIG. 3, which illustrates a support membrane M1 pre-glued to a panel made of plywood, gypsum, rubber or fibro concrete 51. In the other embodiment illustrated in FIG. 4, the support membrane M2 according to the invention, is pre-glued and positioned in between two panels of gypsum, plywood, rubber or fibro concrete.

To the inventor's knowledge, there is no membrane so far, that satisfies all the functions mentioned hereinabove, while still having the very high levels of acoustic and thermal performances that are obtained.

The following example will better illustrate the invention as described.

EXAMPLE

A membrane support M2 according to the invention, as shown in FIG. 2, has been made and tested. This membrane had a thickness of 4.8 mm and a weight of 370 grams per square meter. Its basic structure was as follows:

a base layer 1 made of polyester fibers and reflective polyester fibers having a thickness of 2.2 mm and a weight of 185 grams per square meter;

an anchoring membrane 2 applied by thermo-fusion, with a low density and a thickness of 4 mm; and a positioning layer 3 made of synthetic and reflective polyester fibers having a thickness of 2.2 mm and a weight of 185 grams per square meter.

The addition of reflective fibers at 17% of the initial volume of polyester fibers in the base layer 1 has shown a thermal improvement by reflection of about 23%.

The results obtained during these tests, have been excellent and correspond to what has been disclosed hereinabove in connection with the acoustic effect, heat reflection, protection against humidity and reducing tension effects.

Of course, numerous modifications could be made to the preferred embodiments of the invention that have been described, without departing from the scope of the present invention as defined in the attached claims.

What is claimed is:

1. A support membrane devised to be used with a covering installed onto a carrying surface, said support membrane comprising:

a base layer made of fibers and devised to be positioned onto the carrying surface in order to absorb sound waves and to level irregularities of the carrying surface;

a positioning layer made of fibers, said positioning layer being devised to receive the covering and act as an anchor in order to reduce the tension effect on the covering when the covering is made of wood, ceramic or placopaster, whether vertical in the case of a wall, or horizontal in the case of a floor; and an anchoring membrane acting as a vapor barrier, wherein said anchoring membrane is applied in a liquid form by thermofusion simultaneously between and onto both said base layer and said positioning layer thereby connecting said base layer and said positioning layer and providing an integral cohesion of said base layer and said positioning a layer, said anchoring membrane providing a mechanical support and a non-delamination of said base layer and said positioning layer.

2. The support membrane according to claim 1, wherein the base layer has a thickness ranging from 1 to 8 mm and the anchoring membrane has a thickness ranging from 1 to 6 mm.

3. The support membrane according to claim 1, wherein the positioning layer has a thickness ranging from 1 to 6 mm.

4. The support membrane according to claim 1, wherein the base layer and the positioning layer are made of needled or weaved fibers, and each has a weight ranging from 35 to 3000 grams per square meter.

5. The support membrane according to claim 1, wherein the base layer, the positioning layer or both, comprise an antimicrobial agent.

6. The support membrane according to claim 1, wherein the base membrane, the positioning layer or both comprise nanotechnological fibers covered with a layer of metal, in order to give a reflective effect to said base layer or anchoring membrane.

7. The support membrane according to claim 1, wherein the anchoring membrane comprises metalized reflective particles incorporated therein.

8. The support membrane according to claim 1, wherein the support member is pre-glued in a monolayer or multi-layer form onto a panel made of plywood, gypsum, rubber, fibro concrete or bitumen.

9. Use of a support membrane according to claim 1, for the construction of floor, ceiling or residential wall.

10. The support membrane according to claim 3, wherein: the base layer has a thickness ranging from 1 to 8 mm and the anchoring membrane acting as a vapor barrier has a thickness ranging from 1 to 6 mm, and the base layer and the positioning layer are made of needled or weaved fibers, and each has a weight ranging from 35 to 3000 grams per square meter.

11. The support membrane according to claim 10, wherein the base layer, the positioning layer or both, comprise an antimicrobial agent.

12. The support membrane according to claim 11, wherein the base membrane, the positioning layer or both, comprise nanotechnological fibers covered with a layer of metal, in order to give a reflective effect to said base layer or anchoring membrane.

13. The support membrane according to claim 12, wherein the anchoring membrane comprises metallised reflective particles incorporated therein.

14. The support membrane according to claim 10, wherein the support membrane is pre-glued in a monolayer or multi-layer form onto a panel made of plywood, gypsum, rubber, fibro-concrete or bitumen.

15. The support membrane according to claim 12, wherein the support membrane is pre-glued in a monolayer or multi-layer form onto a panel made of plywood, gypsum, rubber, fibro-concrete or bitumen.

16. The support membrane according to claim 1, wherein said carrying surface is a floor, ceiling or residential wall.

17. The support membrane according to claim 11, wherein said carrying surface is a floor, ceiling or residential wall.

18. The support membrane according to claim 12, wherein said carrying surface is a floor, ceiling or residential wall.

* * * * *